US006925716B2

(12) United States Patent
Bressler et al.

(10) Patent No.: US 6,925,716 B2
(45) Date of Patent: Aug. 9, 2005

(54) SHAVING APPARATUS

(75) Inventors: Peter Bressler, Philadelphia, PA (US); David Schiff, Highland Park, NJ (US)

(73) Assignee: Eveready Battery Company, Inc., St. Louis, MO (US)

( * ) Notice: Subject to any disclaimer, the term of this patent is extended or adjusted under 35 U.S.C. 154(b) by 1 day.

(21) Appl. No.: 10/728,044

(22) Filed: Dec. 4, 2003

(65) Prior Publication Data

US 2005/0120559 A1 Jun. 9, 2005

(51) Int. Cl.[7] ..... B26B 21/44
(52) U.S. Cl. ..... 30/41; 30/538
(58) Field of Search ..... 30/41, 541, 538; 132/292

(56) References Cited

U.S. PATENT DOCUMENTS

| | | | | |
|---|---|---|---|---|
| 1,899,841 A | | 2/1933 | Acken | 30/41 |
| 3,053,422 A | | 9/1962 | Tenison | 222/399 |
| 3,703,765 A | | 11/1972 | Perez | 30/41 |
| 3,726,009 A | | 4/1973 | Hackmyer | 30/41 |
| 4,023,269 A | | 5/1977 | Lopez, Jr. | 30/41 |
| 4,077,119 A | | 3/1978 | Sellera | 30/41 |
| 4,177,556 A | | 12/1979 | Galli, Jr. | 30/41 |
| 4,377,034 A | | 3/1983 | Druash et al. | 30/41 |
| 4,433,483 A | | 2/1984 | Lazarus | 30/41 |
| 4,562,643 A | | 1/1986 | Cataudella | 30/41 |
| 4,635,361 A | * | 1/1987 | DeMars | 30/41 |
| 4,716,652 A | * | 1/1988 | Cataudella | 30/41 |
| 4,753,006 A | * | 6/1988 | Howe | 30/41 |
| 4,760,642 A | * | 8/1988 | Kwak | 30/123 |
| 4,791,723 A | | 12/1988 | Jacobson | 30/41 |
| 4,800,649 A | * | 1/1989 | Cataudella | 30/41 |
| 4,809,432 A | * | 3/1989 | Schauble | 30/41 |

(Continued)

FOREIGN PATENT DOCUMENTS

| | | |
|---|---|---|
| GB | 2 246 314 A | 1/1992 |
| JP | 10-165668 | 6/1998 |

(Continued)

OTHER PUBLICATIONS

Copy of PCT Search Report for Serial No. PCT/IB03/01144 dated Oct. 29, 2003.

*Primary Examiner*—Douglas D Watts
(74) *Attorney, Agent, or Firm*—Michaud-Duffy Group LLP

(57) ABSTRACT

A shaving apparatus is provided that includes a reservoir, a support carriage, a razor cartridge, and a handle. The reservoir, which is operable to contain a non-solid shaving aid material, includes a selectively collapsible side wall surrounding an interior cavity having a volume. The support carriage includes a guide member and an applicator panel. The applicator panel includes one or more ports in fluid communication with the reservoir. One end of the reservoir is attached to the support carriage, and the other end of the reservoir is attached to the handle. The razor cartridge is mounted on the support carriage adjacent the applicator panel. The support carriage is movable relative to the handle in a manner that enables the reservoir side wall to collapse to decrease the volume of the reservoir, and thereby transfer shaving aid material from the reservoir to the one or more ports. According to an aspect of the present invention, a shaving apparatus is provided that includes the above described reservoir, support carriage, and razor cartridge, and a mounting flange, collectively assembled as a replaceable cartridge that is selectively attachable to a handle.

20 Claims, 2 Drawing Sheets

U.S. PATENT DOCUMENTS

| | | | | |
|---|---|---|---|---|
| 4,813,138 | A | 3/1989 | Chen | 30/41 |
| 4,868,982 | A | 9/1989 | McComas | 30/41 |
| 4,888,868 | A | 12/1989 | Pritchard | 30/41 |
| 4,908,945 | A | 3/1990 | Jacobson | 30/41 |
| 4,974,319 | A | 12/1990 | Maguire, Jr. et al. | 30/41 |
| 5,014,427 | A | 5/1991 | Byrne | 30/41 |
| 5,016,351 | A | 5/1991 | Drahus | 30/41 |
| 5,092,041 | A | 3/1992 | Podolsky | 30/41 |
| 5,103,560 | A | 4/1992 | Podolsky | 30/41 |
| 5,168,628 | A | 12/1992 | Mock et al. | 30/41 |
| 5,234,140 | A | 8/1993 | Demarest et al. | 222/394 |
| 5,384,961 | A | 1/1995 | Gregory | 30/41 |
| 5,564,190 | A | 10/1996 | Fleetwood | 30/41 |
| 5,673,485 | A | 10/1997 | Hill | 30/41.5 |
| 5,701,674 | A | 12/1997 | Mitchell | 30/41 |
| 5,761,813 | A | 6/1998 | Frick et al. | 30/41 |
| 5,855,066 | A | 1/1999 | Manger | 30/41 |
| 5,983,500 | A | 11/1999 | da Silva | 30/41 |
| 2004/0177510 | A1 * | 9/2004 | Pennella | 30/41 |

FOREIGN PATENT DOCUMENTS

| | | |
|---|---|---|
| JP | 2003210874 | 7/2003 |
| WO | WO 00 / 10780 | 3/2000 |
| WO | WO 00 / 47374 | 8/2000 |
| WO | WO 02 / 32253 A1 | 4/2002 |

* cited by examiner

SHAVING APPARATUS

BACKGROUND OF THE INVENTION

1. Technical Field

The present invention relates to shaving apparatuses in general, and, more particularly, to shaving apparatuses having mechanisms for providing flowable shaving aid materials.

2. Background Information

The process of removing hair from a dermal surface typically includes the application of a shaving aid material (e.g., shaving cream) to the surface and the separate step of shaving the hair using a razor assembly. The shaving aid material oftentimes includes at least one suitable agent (e.g., a lubricating agent, a skin conditioner, a drag-reducing agent, a depilatory agent, etc.) that enhances the shaving process. The razor assembly is generally a safety razor having a disposable razor cartridge having at least one blade element.

Numerous attempts have been made to combine razor assemblies and mechanisms for dispensing shaving aid materials into unitary shaving apparatuses. Typically, a shaving apparatus that is a combination of a razor assembly and a dispensing mechanism will include a reservoir containing the shaving aid material and one or more passages connecting the reservoir to a point of discharge. The shaving aid material is deposited on the surface being shaved at the point at which the shaving aid material is discharged from the passage(s).

A conventional mechanism for dispensing the shaving aid material from the reservoir includes a source of pressurized gas. Pressurized mechanisms, however, are often costly to manufacture and necessitate additional replacement items. Mechanical systems for powering shaving aid material from the reservoir are also available. They typically require the user to provide some type of actuation in addition to the normal shaving stroke. Hence, the ease of shaving is negatively affected. What is needed, therefore, is a shaving apparatus that dispenses shaving aid material without the aforesaid disadvantages of the prior art.

DISCLOSURE OF THE INVENTION

According to the present invention, a shaving apparatus is provided that includes a reservoir, a support carriage, a razor cartridge, and a handle. The reservoir, which is operable to contain a non-solid shaving aid material, includes a selectively collapsible side wall surrounding an interior cavity having a volume. The support carriage includes a guide member and an applicator panel. The applicator panel includes one or more ports in fluid communication with the reservoir. One end of the reservoir is attached to the support carriage, and the other end of the reservoir is attached to the handle. The razor cartridge is mounted on the support carriage adjacent the applicator panel. The support carriage is slidably movable relative to the handle in a manner that enables the reservoir side wall to collapse to decrease the volume of the reservoir, and thereby transfer shaving aid material from the reservoir to the one or more ports.

According to an aspect of the present invention, a shaving apparatus is provided that includes the above described reservoir, support carriage, and razor cartridge, and a mounting flange, collectively assembled as a replaceable cartridge that is selectively attachable to a handle.

One advantage of the present invention is that the shaving operation may be performed in a single step. More specifically, the shaving aid material is dispensed as needed to the surface to be shaved as the blade is drawn across the surface to be shaved, i.e., in response to the shaving stroke. By dispensing and applying the shaving aid material in response to the shaving stroke, the need for the separate step of applying the shaving aid material is eliminated.

Furthermore, the potential for the shaving aid material to be prematurely washed away (if the shaving operation takes place in a wet environment such as a shower) is decreased. Because the shaving aid material is applied just prior to the blades, the benefits of the shaving aid material are more likely to be substantially realized, which in turn provides increased shaving comfort.

These and other objects, features, and advantages of the present invention will become apparent in light of the detailed description of the present invention.

DETAILED DESCRIPTION OF THE INVENTION

Figure 1:
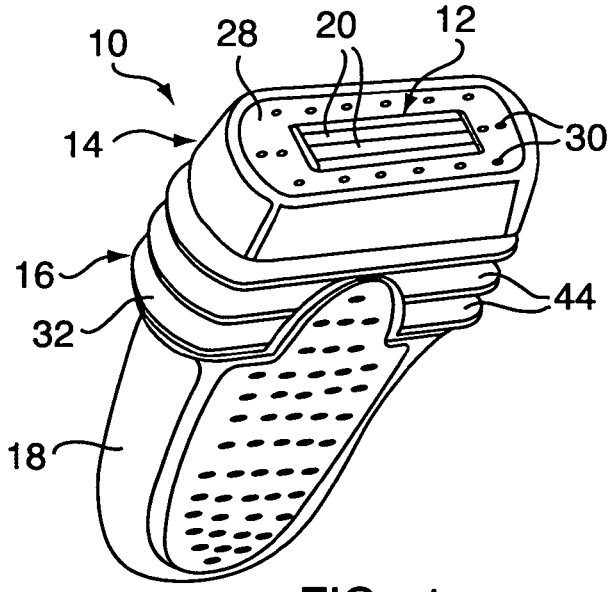
FIG. 1 is an isometric perspective view of the present shaving apparatus.
Figure 2:
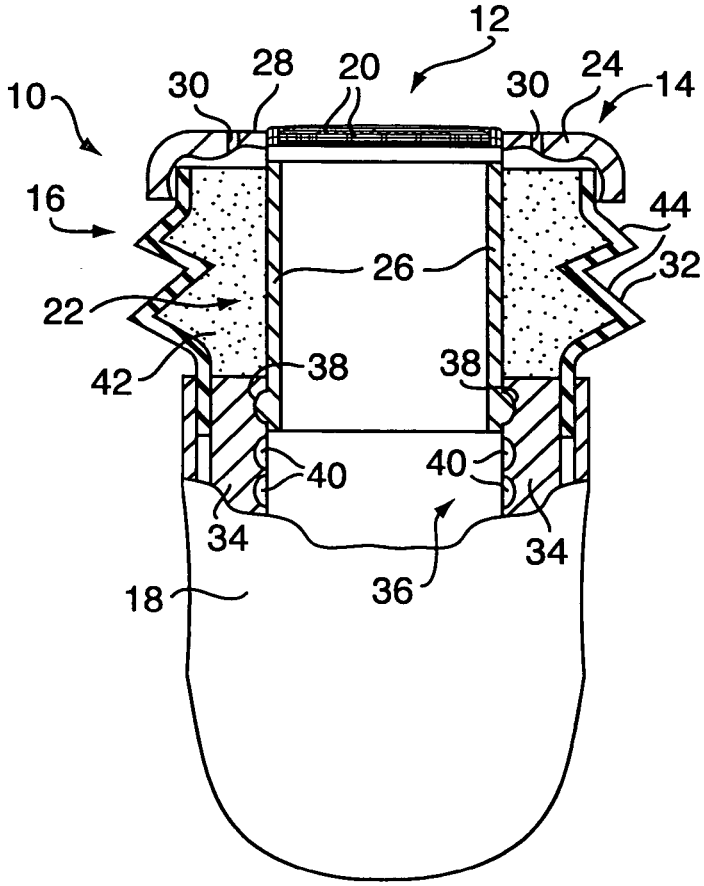
FIG. 2 is a diagrammatic partially sectioned view of an embodiment of the present shaving apparatus.
Figure 3:
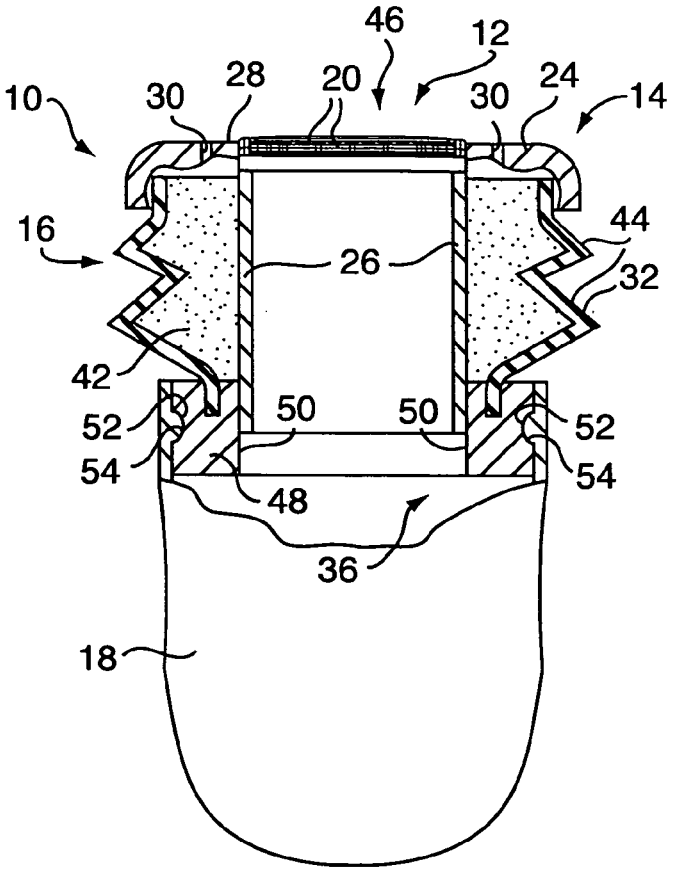
FIG. 3 is a diagrammatic partially sectioned view of an embodiment of the present shaving apparatus that includes a replaceable cartridge.

Referring now to FIGS. 1–3, a shaving apparatus 10 includes a razor cartridge 12, a support carriage 14, a reservoir 16, and a handle 18.

The razor cartridge 12 includes one or more blades 20 mounted in a frame. In some embodiments, the razor cartridge 12 may include additional elements such as a guard bar, comfort strip, or the like. The razor cartridge 12 is mounted to the support carriage 14. The razor cartridge 12 may be pivotable or fixed relative to the support carriage 14. A wide variety of razor cartridges may be used with the present invention. Consequently, the present invention is not limited to any particular razor cartridge.

The support carriage 14 includes a guide member 22 and an applicator panel 24. In the embodiment shown in FIG. 2, the guide member 22 includes one or more guide panels 26 that form a guide mechanism with the handle 18 as will be discussed below. The applicator panel 24 includes a contact surface 28 that is disposed adjacent the razor cartridge 12. The applicator panel 24 shown in FIG. 1, extends around the perimeter of the razor cartridge 12, positioned adjacent the shave plane of the razor cartridge 12. Alternative embodiments can have one or more applicator panel 24 sections that extend adjacent a portion of the razor cartridge 12. The applicator panel 24 includes one or more ports 30 in fluid communication with the reservoir 16. The term "in fluid communication" is used to describe that shaving aid material disposed within the reservoir 16 can travel toward and into the one or more ports 30 from the reservoir 16. Some port 30 embodiments allow unimpeded passage of shaving aid material through the port 30, while other port embodiments include a valve arrangement that selectively allows passage of shaving aid material through the port 30. The shaving aid material passes through the port(s) 30 to the contact surface 28 of the applicator panel 24.

The reservoir 16 is operable to contain a non-solid (e.g., liquid, gel, etc.) shaving aid material. Shaving aid materials include, but are not limited to lubricating agents, drag reducing agents, depilatory agents, cleaning agents, medicinal agents, and the like that enhance the shaving process. The reservoir 16 includes a selectively collapsible side wall 32 surrounding an interior cavity 42 having a volume. The side wall 32 includes a first end, a second end, and one or more pleats 44 disposed between the ends. The side wall 32 is sufficiently flexible so as to permit the pleats 44 to be: 1) expanded to a first position wherein the reservoir 16 interior cavity 42 has a first volume; and 2) collapsed to a second position wherein the reservoir 16 interior cavity 42 has a second volume. The first volume is greater than the second volume by a change in volume that represents a desirable amount of shaving aid material. The first end of the reservoir side wall 32 is attached to the support carriage 14 and the second end of the reservoir side wall 32 is attached to the handle 18.

Referring to FIG. 2, the handle 18 includes one or more guide panels 34 that mate with the guide panels 26 attached to the support carriage 14 to form the guide mechanism mentioned above. The guide mechanism guides movement of the support carriage 14 (and razor cartridge 12 attached thereto) relative to the handle 18. The guide panels 26,34 shown in FIG. 2, for example, limit the movement to a linear motion wherein the support carriage 14 and the handle 18 can be selectively moved toward and away from each other.

In some embodiments, the shaving apparatus 10 includes an adjustable positioner 36 for selectively positioning the support carriage 14 relative to the handle 18. A plurality of mating male buttons 38 and female indentations 40 are shown in FIG. 2 as an example of an adjustable positioner 36. Other positioning mechanisms may be used alternatively. The positioner 36 enables the support carriage 14 and handle 18 to be maintained in discrete relative positions. For example, the positioner 36 embodiment shown in FIG. 2 includes mating male buttons 38 and female indentations 40 that together define distinct relative positions. The amount of travel between discrete positions can be chosen to decrease the interior cavity 42 volume by a predetermined amount; e.g., an amount that equals a desirable amount of shaving aid material for a particular shave.

In the operation of the above-described shaving apparatus, the shaving apparatus 10 is pressed against the surface to be shaved. The pressure applied against the contact surface 28 of the applicator panel 24 transfers to the selectively collapsible side wall 32 of the reservoir 16. If sufficient pressure is applied, the side wall 32 will collapse some amount, causing the volume of the reservoir interior cavity 42 to decrease. In the embodiment wherein the collapsible side wall 32 includes one or more pleats 44, the pleats 44 fold together to decrease the interior cavity 42 volume. The pressure causing the interior cavity 42 to decrease in volume provides the force necessary to expel shaving aid material from the reservoir 16. The shaving aid material travels through the one or more ports 30 to the contact surface 28 of the applicator panel 24, where it is applied to the surface being shaved. Movement of the applicator panel 24 toward the handle 18 is guided by the mating guide panels 26,34.

In those embodiments where the shaving apparatus 10 includes an adjustable positioner 36, the support carriage 14 and the handle 18 can be moved to the next discrete position by applying a force to one or both of the support carriage 14 an/or the handle 18 that is sufficient dislodge the mating set of buttons 38 and indentations 40, and move the relative elements to an adjacent set.

Figure 4:
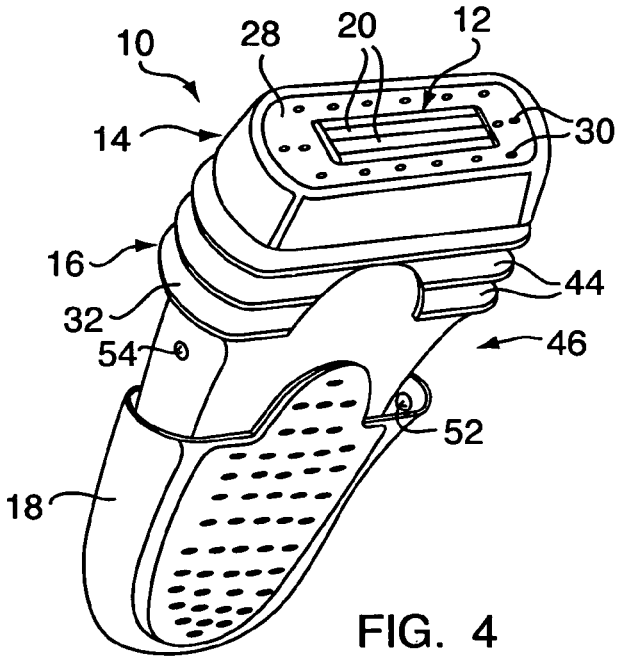
FIG. 4 is a diagrammatic partially exploded view of an embodiment of the present shaving apparatus that includes a replaceable cartridge.

Referring to FIGS. 3 and 4, an alternative embodiment of the present shaving apparatus 10, includes a replaceable cartridge 46 and a handle 18. The replaceable cartridge 46 includes a razor cartridge 12, a support carriage 14, a mounting flange 48, and a reservoir 16. The razor cartridge 12 and support carriage 14 are the same as those described above. The mounting flange 48 preferably includes one or more guide panels 50 that mate with the guide panels 26 attached to the support carriage 14 to form a guide mechanism similar to that described above vis-a-vis the support carriage 14 and the handle 18. As will be described below, the guide mechanism guides movement of the support carriage 14 (and razor cartridge 12 attached thereto) relative to the handle 18. The guide panels 26,50 limit the movement to a linear motion wherein the support carriage 14 and the mounting flange 48 can be selectively moved toward and away from each other. The mounting flange 48 further includes a first portion of a mechanism for selectively attaching the mounting flange 48 (and therefore the replacement cartridge 46) to the handle 18. Details of the mechanism for selectively attaching the mounting flange 48 are provided below. The reservoir 16 is similar to that described above, except that the second end of the reservoir 16 is attached to the mounting flange 48.

The handle 18 includes a second portion of the mechanism for selectively attaching the mounting flange 48 to the handle 18. In the embodiment shown in FIGS. 3 and 4, the first portion of the mechanism includes one or more male buttons 52 attached to the handle 18. The second portion of the mechanism includes one or more female indentations 54 disposed in the mounting flange 48. The mating male buttons 52 and female indentations 54 operate to selectively attach the mounting flange 48, and therefore the replacement cartridge 46, to the handle 18. Other mechanisms for selectively attaching the mounting flange 48 to the handle 18 may be used alternatively.

Similar to the present shaving apparatus 10 described first above, the replacement cartridge may also include an adjustable positioner 36 for selectively positioning the support carriage 14 relative to the handle 18. Also similar to the present shaving apparatus 10 described first above, a first portion of the adjustable positioner 36 may be attached to the support carriage 14 and a second portion of the adjustable positioner 36 may be attached to the handle 18. Alternatively, a first portion of the adjustable positioner 36 may be attached to the support carriage 14 and a second portion of the adjustable positioner 36 may be attached to the mounting flange 48.

The above-described embodiment of the present shaving apparatus 10 operates similar to the embodiment of the shaving apparatus 10 described first above. When the reservoir 16 is substantially empty, the replacement cartridge 46 can be selectively detached from the handle 18 and replaced with a new replacement cartridge 46. Alternatively, if the user desires to utilize more than one type of shaving aid material, replacement cartridges 46 containing different shaving aid materials can be removed and attached depending on the user's desire.

Although this invention has been shown and described with respect to the detailed embodiments thereof, it will be understood by those of skill in the art that various changes may be made and equivalents may be substituted for elements thereof without departing from the scope of the invention.

What is claimed is:

1. A shaving apparatus, comprising:

a reservoir operable to contain a non-solid shaving aid material, the reservoir including a selectively collapsible side wall surrounding an interior cavity having a volume, the side wall including a first end and a second end;

a support carriage that includes a guide member and an applicator panel that includes one or more ports in fluid communication with the reservoir, wherein the first end of the reservoir is attached to the support carriage;

a razor cartridge having one or more razor blades, mounted on the support carriage adjacent the applicator panel; and a handle, wherein the second end of the reservoir is attached to the handle;

wherein the support carriage and the razor cartridge are relatively movable in a manner that enables the side wall to collapse to decrease the volume of the reservoir, and transfer shaving aid material from the reservoir to the one or more ports.

2. The shaving apparatus of claim 1, wherein the selectively collapsible side wall of the reservoir includes one or more pleats.

3. The shaving apparatus of claim 2, wherein the side wall is sufficiently flexible so as to permit the reservoir to be expanded to a first position wherein the reservoir interior cavity has a first volume, and collapsed to a second position wherein the reservoir interior cavity has a second volume;

wherein the first volume is greater than the second volume.

4. The shaving apparatus of claim 3, wherein the first volume is greater than the second volume by a predetermined amount.

5. The shaving apparatus of claim 3, further comprising an adjustable positioner for selectively positioning the support carriage relative to the handle.

6. The shaving apparatus of claim 1, wherein the side wall is sufficiently flexible so as to permit the reservoir to be expanded to a first position wherein the reservoir interior cavity has a first volume, and collapsed to a second position wherein the reservoir interior cavity has a second volume;

wherein the first volume is greater than the second volume.

7. The shaving apparatus of claim 6, wherein the first volume is greater than the second volume by a predetermined amount.

8. The shaving apparatus of claim 6, further comprising an adjustable positioner for selectively positioning the support carriage relative to the handle.

9. A shaving apparatus, comprising a replaceable cartridge that includes a reservoir operable to contain a non-solid shaving aid material, the reservoir including a selectively collapsible side wall surrounding an interior cavity having a volume, the side wall including a first end and a second end;

a support carriage that includes a first guide member, and an applicator panel that includes one or more ports in fluid communication with the reservoir, wherein the first end of the reservoir is attached to the support carriage;

a mounting flange having a second guide member that cooperates with the first guide member to guide relative motion between the mounting flange and the support carriage, wherein the second end of the reservoir is attached to the flange; and a razor cartridge having one or more razor blades, mounted on the support carriage adjacent the applicator panel; and a handle, wherein the mounting flange is selectively attachable to the handle;

wherein the support carriage and the razor cartridge are movable relative to the mounting flange and the handle in a manner that enables the side wall to collapse to decrease the volume of the reservoir, and transfer shaving aid material from the reservoir to the one or more ports.

10. The shaving apparatus of claim 9, wherein the selectively collapsible side wall of the reservoir includes one or more pleats.

11. The shaving apparatus of claim 10, wherein the side wall is sufficiently flexible so as to permit the reservoir to be expanded to a first position wherein the reservoir interior cavity has a first volume, and collapsed to a second position wherein the reservoir interior cavity has a second volume;

wherein the first volume is greater than the second volume.

12. The shaving apparatus of claim 11, wherein the first volume is greater than the second volume by a predetermined amount.

13. The shaving apparatus of claim 12, further comprising an adjustable positioner for selectively positioning the support carriage relative to the handle.

14. The shaving apparatus of claim 9, wherein the side wall is sufficiently flexible so as to permit the reservoir to be expanded to a first position wherein the reservoir interior cavity has a first volume, and collapsed to a second position wherein the reservoir interior cavity has a second volume;

wherein the first volume is greater than the second volume.

15. The shaving apparatus of claim 14, wherein the first volume is greater than the second volume by a predetermined amount.

16. The shaving apparatus of claim 14, further comprising an adjustable positioner for selectively positioning the support carriage relative to the handle.

17. A replacement cartridge for a shaving apparatus, comprising:

a reservoir operable to contain a non-solid shaving aid material, the reservoir including a selectively collapsible side wall surrounding an interior cavity having a volume, the side wall including a first end and a second end;

a support carriage that includes a first guide member, and an applicator panel that includes one or more ports in fluid communication with the reservoir, wherein the first end of the reservoir is attached to the support carriage;

a mounting flange having a second guide member that cooperates with the first mounting flange to guide relative motion between the mounting flange and the support carriage, wherein the second end of the reservoir is attached to the flange; and a razor cartridge having one or more razor blades, mounted on the support carriage adjacent the applicator panel; and wherein the support carriage and the razor cartridge are movable relative to the mounting flange in a manner that enables the side wall to collapse to decrease the volume of the reservoir, and transfer shaving aid material from the reservoir to the one or more ports.

18. The shaving apparatus of claim 17, wherein the selectively collapsible side wall of the reservoir includes one or more pleats.

19. The shaving apparatus of claim 18, wherein the side wall is sufficiently flexible so as to permit the reservoir to be expanded to a first position wherein the reservoir interior cavity has a first volume, and collapsed to a second position wherein the reservoir interior cavity has a second volume; wherein the first volume is greater than the second volume.

20. The shaving apparatus of claim 19, wherein the first volume is greater than the second volume by a predetermined amount.

* * * * *